US005605480A

United States Patent [19]

Wright

[11] Patent Number: 5,605,480

[45] Date of Patent: Feb. 25, 1997

[54] EASILY MANEUVERABLE VESSEL PROPELLED BY EIGHT JETS AND SAILS

[76] Inventor: Clarence E. Wright, 1900 Maple Rd., Williamsville, N.Y. 14221

[21] Appl. No.: 555,122

[22] Filed: Nov. 8, 1995

[51] Int. Cl.[6] ..... B63H 11/117

[52] U.S. Cl. ..... 440/43; 114/39.1; 114/63; 114/71; 114/91; 114/151

[58] Field of Search ..... 114/39.1, 151, 114/91, 71, 106, 56, 65 R, 63; 440/43

[56] References Cited

U.S. PATENT DOCUMENTS

| | | | |
|---|---|---|---|
| 122,429 | 1/1872 | Beidler . | |
| 298,019 | 5/1884 | Oram . | |
| 921,849 | 5/1909 | Larr . | |
| 1,259,753 | 3/1918 | Lassell . | |
| 2,176,796 | 10/1939 | Hayfield . | |
| 2,356,301 | 8/1944 | Brase . | |
| 3,121,994 | 2/1964 | Aldropp | 440/43 |
| 3,122,121 | 2/1964 | Krauth | 114/151 |
| 3,675,611 | 7/1972 | Glass | 114/151 |
| 3,749,042 | 7/1973 | Jackson | 114/106 |
| 3,827,386 | 8/1974 | Faden | 114/61 |
| 3,942,458 | 3/1976 | Hankin | 114/71 |
| 4,364,322 | 12/1982 | Van Roon | 114/71 |
| 5,103,752 | 4/1992 | Himeda | 114/39.1 |

OTHER PUBLICATIONS

United Fund brochure entitled SPICE, dated Oct. 1958 (5 pages).

*Primary Examiner*—Sherman Basinger

*Attorney, Agent, or Firm*—Polster, Lieder, Woodruff & Lucchesi, L.C.

[57] ABSTRACT

A vessel having a hull of effective rectangular configuration and utilizing a dual propulsion and steering arrangement, including sails and an eight jet system, thus making the vessel extremely maneuverable.

19 Claims, 3 Drawing Sheets

EASILY MANEUVERABLE VESSEL PROPELLED BY EIGHT JETS AND SAILS

BACKGROUND OF THE APPLICATION

This invention relates to vessels having an effective rectangular hull, and in particular a floating home type vessel which is easily maneuverable and which has sails.

Many people enjoy vacationing in floating homes, often known as "houseboats". They are normally low freeboard and shallow draft vessels intended for use on inland waters. They would not be safe at sea. These vessels typically are powered by one or more propellers at the stem to propel them forwardly. Steering is accomplished either with the use of a rudder or by rotating these rearwardly positioned motors. In some cases the boat may be moved backwards by reversing the propellers. This works well in small boats. However, larger boats (i.e., boats in excess of fifty feet) do not have the maneuverability of small boats and the use of only stem mounted propellers makes these boats difficult to maneuver.

These vessels typically use a large amount fuel when they are operated. It would be desirable to provide sails on the vessel which may be used in lieu of the motors or in combination with the motors to reduce the amount of fuel used. However, a typical "houseboat" is not a good sailing vessel without means to greatly increase maneuverability because the shallow draft promotes leeway when close hauled, coming about is difficult or impossible, and the blunt hull form has high drag which increases both defects.

SUMMARY OF THE INVENTION

One object of the present invention is to provide a sea going floating home type vessel which is easily maneuverable.

Another object is to provide such a vessel which includes sails.

Another object is to provide such a vessel which effectively has an eight jet propulsion and steering system, the jets being mounted in pairs in the approximate corners of the boat.

These and other objects and advantages will become apparent to those skilled in the art in light of the following disclosure and accompanying drawings.

In general, the present invention is embodied in vessels having hulls of effective rectangular configuration such as a barge, houseboat, catamaran or the like, and involves the combination of a sail propulsion system and an eight jet propulsion system to more precisely steer and more efficiently propel the vessel.

Thus, in accordance with the invention, as illustrated in the Detailed Description, the specific vessel illustrated is a floating home, commonly called a "houseboat". This vessel has generally an effectively rectangular hull with a generally flat bottom. The vessel shown for illustrative purposes has a bottom deck, a main deck, and a top deck. Many other vessel configurations can be used with this invention. The vessel shown has a beam of about 30 feet and an overall length of about 90 feet. The vessel can be propelled by an eight jet system aligned in pairs as follows: a stem-port pair, a stem-starboard pair, a bow-port pair, and a bow-starboard pair. The jets are preferably below the water line. The jets are individually and selectively operable so as to provide a wide range of vessel movements. The jets preferably form an angle of about 45° with a center line of the vessel.

In the illustrated embodiment, a mast extends above the upper deck. The mast is pivotal about a pivot point to be movable between an upright position and a folded position. The pivot point is located adjacent the upper deck such that the mast can be folded over the upper deck. A self-furling mainsail and a self-furling jib are provided so that the boat can be driven under power of sail. The furling and unfurling of the sails is preferably performed with little effort in order to facilitate single handed operation. The sails may be used with or without the jets. The jets may be used to enable the vessel to more accurately maintain a desired course when under sail power.

The vessel has a shallow draft (only three or four feet) and can be made to extend above the water line only about fifteen feet. The boat may thus be used in shallow waters and can pass under most bridges.

These and other objects and advantages of the invention will become apparent to those knowledgeable in the art in view of the description and claims hereinafter set forth.

BRIEF DESCRIPTION OF THE DRAWINGS

In the drawings where like numbers refer to like parts wherever they occur.

DESCRIPTION OF THE PREFERRED EMBODIMENT

Figure 1:
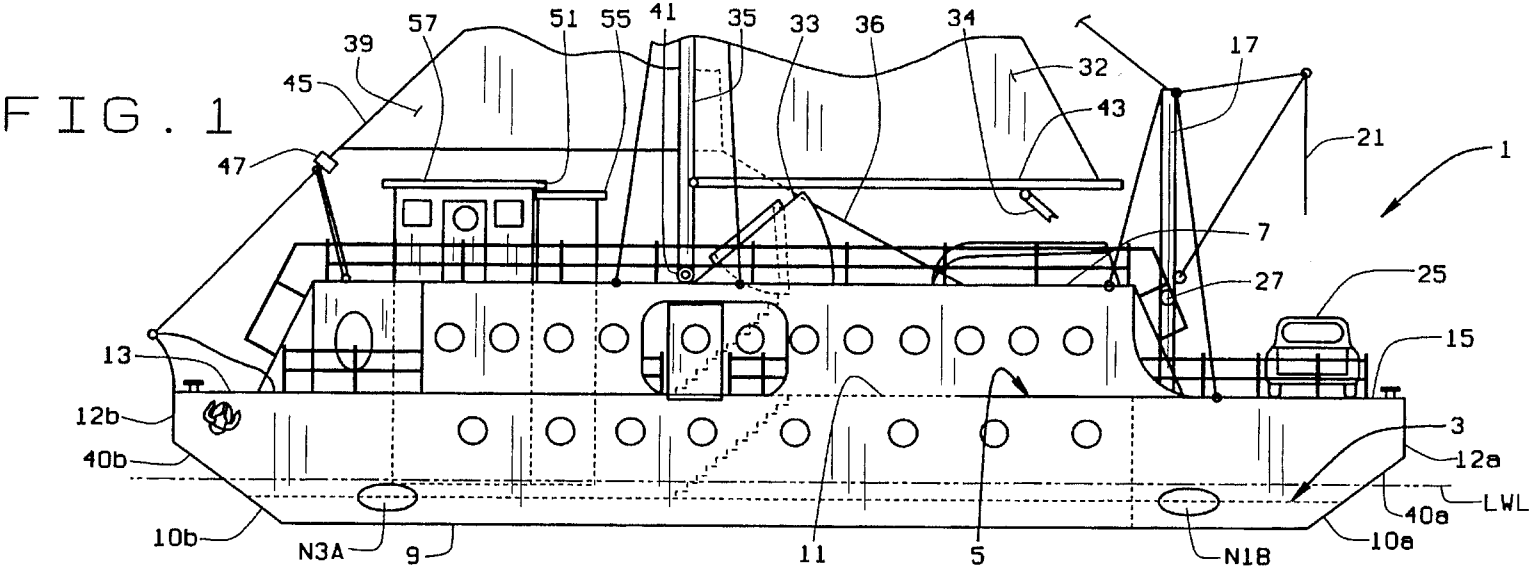
FIG. 1 is an elevational view of a vessel incorporating a propulsion system of the present invention.
Figure 2:
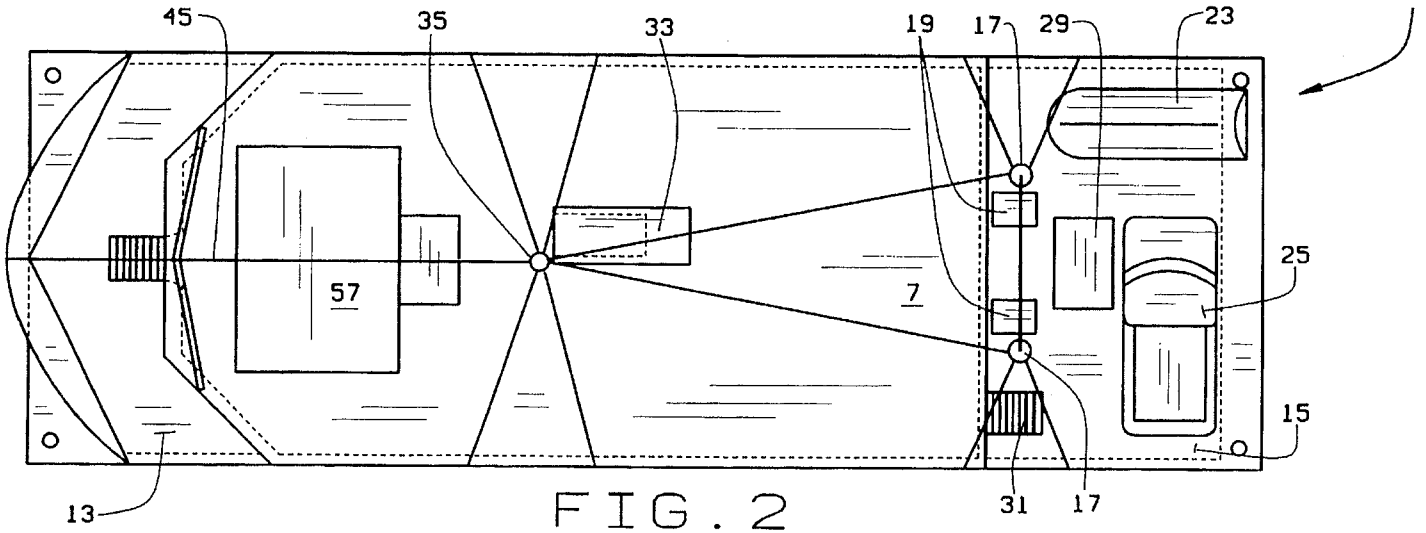
FIG. 2 is a top plan view of the vessel.

The vessel chosen for illustrative purposes is a floating home 1 and is shown generally in FIGS. 1 and 2. The vessel 1 has an overall length of ninety (90) feet and a beam of thirty (30) feet. The boat 1 has a bottom deck 3, which is below the water line LWL, a main deck 5, and a top deck 7. Although it is large, it has a shallow draft, preferably only four (4) feet or less and the top deck 7 is only fifteen (15) feet above the water line LWL. The shallow draft for a boat of its size allows the vessel 1 to be used in shallow waters. The low height of the top deck 7 allows the boat 1 to pass under relatively low bridges.

Figure 4:
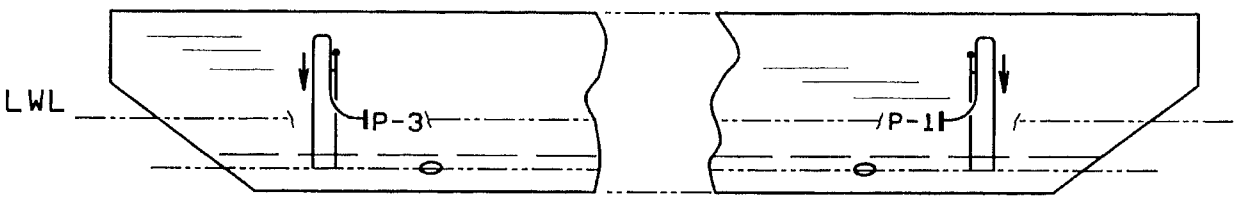
FIG. 4 is a diagrammatic side elevational view of the propulsion system.
Figure 5:
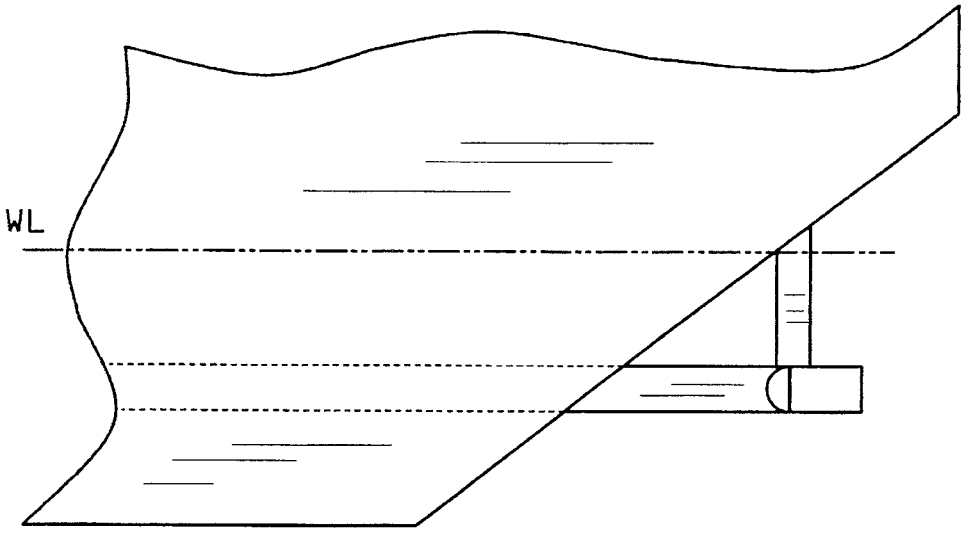
FIG. 5 is a sectional elevational view near the stem of the vessel.
Figure 6:
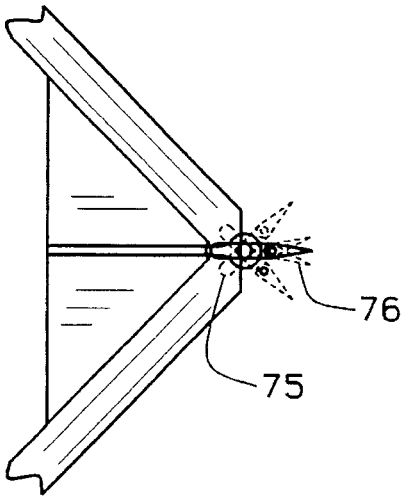
FIG. 6 is a sectional plan view of the stem of the vessel showing rudder details.
Figure 7:
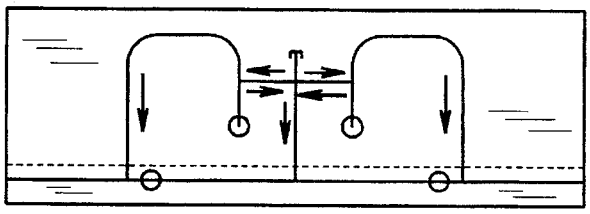
FIG. 7 is a rear elevational view of the vessel, also showing the rudder arrangement.

The bottom 9 preferably is a double bottom and the vessel 1 includes water-tight bulkheads for protecting the vessel 1 against sinking. As best seen in FIGS. 1 and 4, the flat bottom 9 does not extend the full or overall length of the vessel 1, rather, it has a length of about seventy-four (74) feet (about 80% of the overall length of the boat). Ramped surfaces 10*a* and 10*b* at the stem and bow, respectively extend outwardly and upwardly from the bottom 9 to vertical surfaces 12*a* and 12*b*, which in turn, extend to the main deck 5.

The middle portion 11 of the main deck is enclosed, leaving the bow and stem portions 13 and 15 exposed. Kingposts 17 are mounted to the stem portion 15 of the main deck 5. The kingposts 17 have associated winches 19 for hoisting operations. The ropes 21 may be used to lift small boats 23 or cars 25 onto the rear deck 15 where they may be secured. The kingposts 17 have a pivot point 27 at a point approximately level with the top deck 7. The pivot point 27 allows the kingposts 17 to be folded or pivoted over, such that the top portion of the kingposts 17 extend over the rear deck 15. Folding the kingposts 17 reduces the overall height of the boat 1 and permits the boat 1 to pass under low bridges. For many applications kingposts 17 are not necessary. The rear deck 15 also has a hatch 29 which permits access to the bottom deck 3 and a ladder 31 which permits access to the top deck 7.

The top deck 7 includes a hatch 33 which provides access to a stairwell serving the main deck 11 from the top deck 7 and the bottom deck 3. A mast 35 is secured at its base to the bottom deck 3 and extends upwardly through the boat 1 and above the top deck 7. The mast 35 supports a mainsail 32 and a jib 39. The mast 37 pivots or folds over the top deck 7 and includes a pivot point 41 near the level of the top deck 7. The mast 35 folds forwardly, across the top deck 7 and over the forward portion 13 of the main deck 5. The mainsail 32 is preferably a self-furling sail. The jib 39 extends up a stay 45 and is preferably a self-furling jib furlet 47. When the vessel 1 is used in suitable waters, the mast 35 may be raised and the sails may be used to power the boat 1. The use of the sails will obviously reduce the fuel consumed by the vessel 1. When the vessel 1 is navigated in low bridge areas, the mast 35 can be folded or pivoted over its pivot point 41. As with the kingposts 17, this will reduce the overall height of the boat 1, and the vessel 1 will be able to pass under relatively low bridges. Again in many applications, a foldable mast 35 will not be used.

A raisable and lowerable pilot house 51 is shown in FIG. 1 in its raised position. The jib 39 is mounted on the stay 45 and mast 35 such that the pilot house 51 may be fully elevated when the sails are raised. An elevator 55 is provided next to the pilot house 51 to allow for access to all three decks without using any of the staircases. The pilot house 51 and the space below are a combined structure which is raisable and lowerable, for example, by hydraulics. When the pilot house 51 is lowered, its roof 57 rests on the top deck 7. Because the mast 35 extends across the top deck 7 when it is folded over, the pilot house 51 must be lowered before the mast 35 is lowered. A raisable pilot house 51 will not be used in many constructions.

The jet propulsion system of the vessel 1 is shown in FIGS. 3–7. There are no exposed propellers which can be damaged by logs, rocks, etc.

Figure 3:
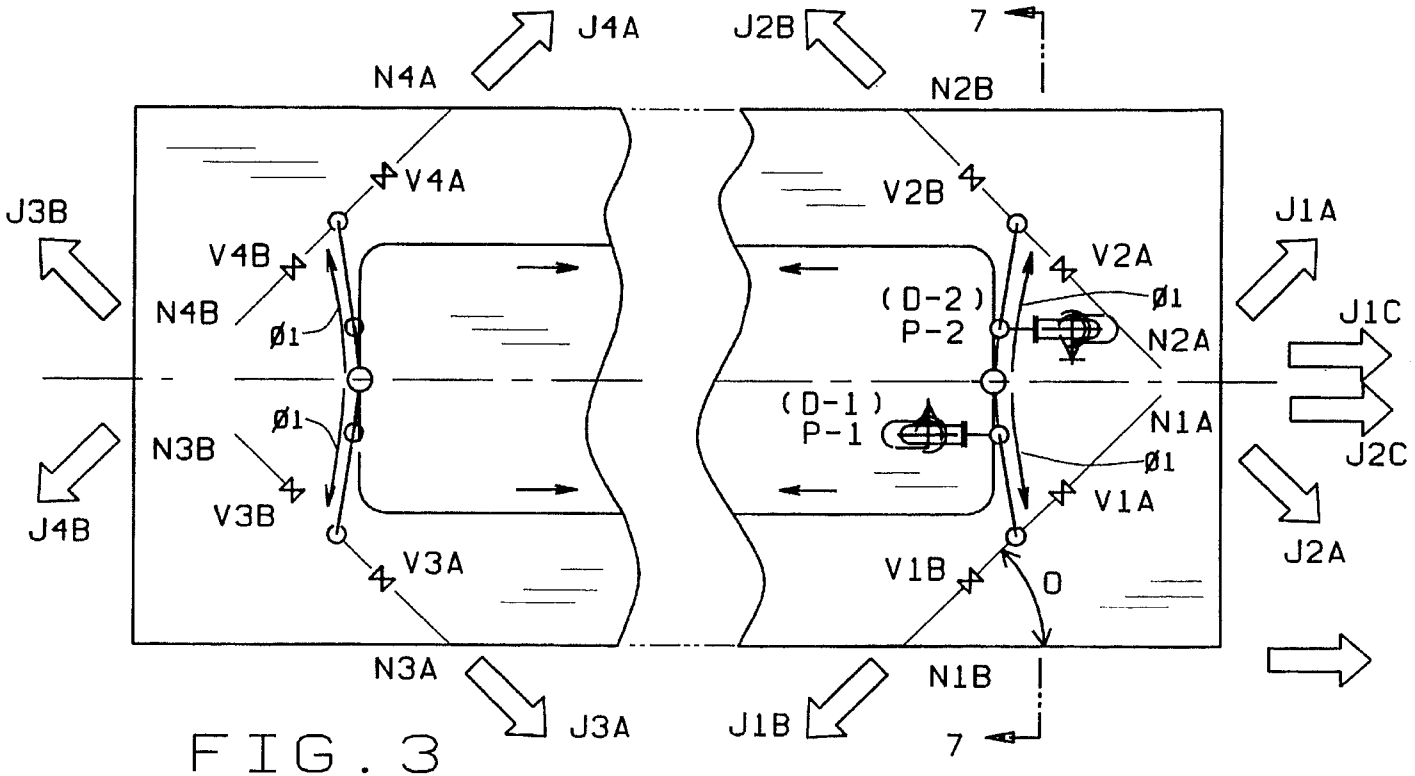
FIG. 3 is a diagrammatic plan view of the propulsion system used in the vessel.

Basically, the system as shown on FIG. 3 is comprised of pumps and drivers, connecting piping, appropriate controls (not shown) and eight sets of powered (normally open or closed) valves and nozzles to create the corresponding jets:

V1A plus N1A to create J1A, or J1C by means of a turning vane;

V1B plus N1B to create J1B;

V2A plus N2A to create J2A, or J2C by means of a turning vane;

V2B plus N2B to create J2B;

V3 A plus N3 A to create J3A;

V3B plus N3B to create J3B;

V4A plus N4A to create J4A; and

V4B plus N4B to create J4B.

All of the sets are arranged in plan so that the centerlines of their nozzles are at a typical angle Phi ($\phi$) of about 45 degrees to the vessel centerline. The inboard piping serving them is not necessarily at the same angle in all areas.

The quantity of water forming the jets is furnished by pumps driven by internal combustion engines, or other types of drivers D-1 and D-2 (not shown in detail, but shown schematically in FIG. 3) and driving pumps P-1 and P-2, respectively. The pumps preferably have bottom inlets and take suction from sea chests in the bottom of the vessel through slots which serve as strainers. The jet velocities are the result of interchangeable nozzles having different inside diameters which can be selected to match desired pump operating characteristics, i.e., the head loss through one or more nozzles can be selected to correspond to pump and driver capabilities. All nozzles need not have the same internal diameter. With D-1 and D-2 being 300 hp diesel engines and P-1 and P-2 each having rating points of 7000 gpm at 100 feet TDH, the expected maximum forward no wind speed of the vessel would be about 5 knots. Since speed is a low priority for the described vessel, 5 knots is considered adequate. The maximum forward speed under sails alone would also be about 5 knots.

Either or both of the engine-pump units can deliver a variable flow of water, depending on engine-pump speeds, to any combination of nozzles, although flows from opposite jets such as J4A and J4B would usually be of no value. Individual flow volumes through the nozzles need not be controlled, only the total volume flow as determined by engine-pump speeds. The flow will divide between active jets.

It is apparent that there are many combinations of jets which can be used in conjunction with a variable total pumped flow and that the forces acting on the vessel are opposite to the flows and widely variable in magnitude. This results in a propulsion system which provides very precise maneuverability. For example, one of the combinations would be to use only the jets J1A and J2A. This would create a net force to drive the vessel in an ahead direction. Another example would be to use jets J3A, J4B, J2B, and J1A. This would make the vessel rotate clockwise in plan, generally within its own length. Using only J3A and J2B would give the same type of effect. A preference for one or the other of these last two combinations will result from operating experience.

Hand valves can be provided in the connecting piping for maintenance and damage control purposes. Additional engine-pump units can also be provided at the bow if more power or standby reserve is desired.

The ahead direction of jets only propulsion will be the most used and consequently economy of fuel usage for this operation is important. The combination of jets J1C and J2C as created by a special rudder and micro rudder promotes this objective. The described vessel is a special case because the stem nozzles are located where their centerlines intersect and this permits the use of one rudder to create jets J1C and J2C. For the more general cases the stem nozzles could be located forward of the intersection and two rudders would be required. A catamaran vessel is an example: two rudders would be required to create the parallel jets.

The propulsive force exerted on the vessel by a jet of water leaving the vessel is the average mass flow rate times the exit velocity relative to the vessel. For best efficiency, when two or more jets are being used, the jet flows should be parallel to the desired direction of travel. To this end, rudder 75 in FIG. 6 can be locked in a fore and aft position so that it acts as a "turning vane" for both of the adjacent jet flows, thereby causing the forces which change the flow direction of each to act on the vessel. The effective jets then become J1C and J2C. Without the turning vane effect the energy in the jet velocity components acting transverse to the vessel centerline would be lost to turbulence and the ensuing heat generation in the wake. If the change of jet directions could be accomplished without fluid friction the increase in propulsive force for jets now parallel to the vessel centerline instead of at an angle of, say 45 degrees, would be about 41% greater and result in fuel savings of similar amount. Even with an inefficient "turning vane" a propulsive force increase of 25% could be expected. The means for turning the two jets so they are parallel to the vessel centerline is not limited to using a locked in place rudder. Other means, such as retractable or swing away pipe sections, may be more effective, although perhaps more costly.

Fine control of vessel direction under the above combination of jets can be achieved by slight rotations of the fixed rudder. However, the forces acting on the rudder will be considerable. A trim tab 76 on the trailing edge of the fixed rudder, much like those used on airplanes, is a better method because the forces will be smaller and control will require less power.

For all except lengthy fuel saving operations, as above, the fixed rudder will be left unlatched and free to weathervane for accommodating jet J1A or jet J2A.

When operating under sails only, the above rudder would not be in a position to be used for steering. Auxiliary rudders can be provided (not shown) at positions having a good water velocity, such as close to the port and starboard areas at the stem. They should have relatively large areas, because the water velocity is much less than in the way of jets. Also, they can be made retractable when the sails only propulsion is not being used. Both rudder systems can be made to use a common autopilot or other remote control. For emergency situations, the sails only rudders should be such as to permit local manual operation.

The described vessel under sails only would not be a good performer when trying to beat upwind. The shallow draft, blunt hull form, and large superstructure would be the causes. For example, on a port tack (wind over the port side) with sails 39 and 32 held close to the vessel centerline by the main and jib sheets 34 and 36 and on a heading of about 40 degrees from the wind direction, the vessel would make considerable leeway to starboard while moving ahead rather slowly due to drag caused by water and wind. After a time it would be customary to change to the starboard tack, again about 40 degrees from the wind direction. By repeating the tacking the vessel might make good a desired course toward the wind. The time to achieve a given distance on the desired course would depend on the wind but mostly on how well the vessel performs in such an operation. It would not be unreasonable to find that it could not progress along the desired course. It could be such a poor sailing vessel that it would lose instead of gaining distance along the desired course. This would be the case if it could not be made to come about in order to change tacks. To change tacks by jibing such a poor sailor would usually be of little help.

On the other hand, the use of propulsion jets in addition to sails for the preceding example would allow the vessel to make good a course directly into the wind. Tacking would not be required. While on the port tack with sails close hauled, jets J4A and J1A could be activated. With one or both pumps P-1 and P-2 operating to deliver enough water to the jets, the jet forces would overcome the tendency for making leeway to starboard and at the same time increase the forward speed of the vessel. The net effect would be that, with enough jet power compared to wind velocity, the vessel could be made to move directly upwind or on whatever course close to that direction that might be desired. The vessel would be pointing fight but moving diagonally on the desired course. It might look a bit peculiar, but the vessel could move along a narrow river or other channel in such a manner. The transit time would be much improved and fuel would be conserved.

The shape of the hull, i.e. the flat bottom 9 and the slope **10*b*** at the bow, allows the vessel to be run hard aground on sand or mud without serious damage. If the water depth at the stem is five (5) feet or more, the bow jets J3B and J4B can be used to free the vessel. Water from the jets would tend to raise the bow by flotation and the jet forces would act to move the vessel.

As variations within the scope of the appended claims may be apparent to those skilled in the art, the foregoing description is set forth only for illustrative purposes and is not meant to be limiting. For example, sail configurations other than a main sail and a jib could be used. The sail configuration could be that of a sloop, ketch, schooner, yawl, square rigged, etc. Other configurations can also be used for the boat, as long as it is effectively rectangular in shape. The boat could be a barge, catamaran, etc. These examples are merely illustrative.

What is claimed is:

1. In a vessel having a hull which has a stern and bow and is generally of effective rectangular configuration including one of a barge, houseboat, and catamaran, the improvement comprising the vessel having in combination, a sail propulsion system and a jet propulsion system whereby the vessel with both propulsion systems can be more effectively maneuvered than a sail propulsion system and more efficiently propelled than when using either system alone, I) the sail propulsion system comprising,
  a) at least one mast mounted to said hull, and
  b) at least one sail secured to said mast to be selectively furled and unfurled, II) the jet propulsion system being an eight jet arrangement comprising;
  a) a stem-port pair of jets,
  b) a stern-starboard pair of jets,
  c) a bow-port pair of jets,
  d) a bow-starboard pair of jets,
  e) the jets in each said pair being aligned and forming an aligned pair having their flows oriented in opposite directions 180° from each other,
  f) each of the jets having a longitudinal and lateral thrust component,
  g) at least one pump with an inlet through the hull of the vessel and with discharge connected by piping to-all pairs of jets, and
  h) appropriate remotely controlled valves so that jets may be activated in all possible combinations.

2. The vessel of claim 1 wherein the positioning of the jet outlets is at about 45° with respect to a longitudinal centerline of the vessel.

3. The vessel of claim 1 including at least one vane at each of the two stem jet outlets, each said vane being adjustable to re-direct the jets from said outlets toward coincidence with the direction of the longitudinal centerline of the vessel to add to the longitudinal force component and improve propulsion efficiency in the ahead direction of travel.

4. The vessel of claim 3 including a free pivotable trim tab positioned on the trailing edge of each of the vanes.

5. The vessel of claim 1 wherein the sails have the effect of reducing roll in heavy seas.

6. The vessel of claim 1 wherein the sails have the effect of reducing the amount of engine fuel used in propelling the vessel.

7. The vessel of claim 1 wherein the propulsion jet system when used in conjunction with the sails close hauled allows the vessel to make good a course more directly into the wind to save time and allow the use of sail power against a headwind even in narrow passages.

8. The vessel of claim 1 wherein the propulsion jet system provides certain and rapid tacking by coming about or jibing when sails are being used, particularly in order to avoid hazards.

9. The vessel of claim 1 wherein a relatively minor jet propulsion can be used to adjust rudder action when under sail for a weather helm or a lee helm, while still providing some propulsional force in the direction of travel.

10. The vessel of claim 1 including a top deck, and the mast secured to said hull of said boat extends above said top deck.

11. The vessel of claim 10 wherein the said mast is pivotal about a pivot point and movable between an upright position and a folded position, said pivot point being located adjacent to said top deck such that said mast can be folded over said top deck.

12. The vessel of claim 11 including at least a mainsail secured to said mast to be selectively furled and unfurled; and a plurality of mast stays for securing said mast in said upright position.

13. In a vessel having a hull which has a stem and bow and is generally of effective rectangular configuration including one of a barge, houseboat, and catamaran, the improvement comprising the vessel having in combination, a sail propulsion system and a jet propulsion system whereby the vessel with both propulsion systems can be more effectively maneuvered than a sail propulsion system and more efficiently propelled than when using either system alone, the vessel having a top deck, I) the sail propulsion system comprising,
   a) at least one mast mounted to said hull and extending above the top deck, and
   b) at least one sail secured to said mast to be selectively furled and unfurled, II) the jet propulsion system being an eight jet arrangement comprising;
   a) a stem-port pair of jets,
   b) a stern-starboard pair of jets,
   c) a bow-port pair of jets,
   d) a bow-starboard pair of jets,
   e) the jets in each said pair being aligned and forming an aligned pair having their flows oriented in opposite directions 180° from each other,
   f) each of the jets having a longitudinal and lateral thrust component,
   g) at least one pump with an inlet through the hull of the vessel and with discharge connected by piping to all pairs of jets,
   h) appropriate remotely controlled valves so that jets may be activated in all possible combinations, and III) said vessel including a main deck beneath said top deck wherein said main deck includes an enclosed central portion, an open stern portion and an open bow portion, said vessel including kingposts secured to said stem portion of said main deck, said kingposts extending above said top deck and having pivot points such that said kingposts are pivotal between an upright position and a folded position, said pivot point being located along said kingpost such that when said kingpost is folded, the folded kingpost will not extend above the top deck.

14. The vessel of claim 13 wherein said mast is movable between an upright and folded position and said vessel has a draft of about four feet and a height above the water line of about fifteen feet when said mast and kingposts are in their folded position.

15. The vessel of claim 14 wherein vessel has a double hulled bottom.

16. The vessel of claim 15 wherein the beam width is about one-third of the overall length.

17. The vessel of claim 16 wherein the overall length is about 90' and the beam is about 30'.

18. The vessel of claim 17 including a jib stay extending from said mast to a forward point of a bow of said boat, and a jib sail mounted to said jib stay to be selectively furled and unfurled.

19. The vessel of claim 14 including a pilot house, said pilot house being raisable and lowerable between said main deck and said top deck.

* * * * *